US005174725A

United States Patent [19]

Guile et al.

[11] Patent Number: 5,174,725

[45] Date of Patent: Dec. 29, 1992

[54] GEAR PUMP HAVING MULTIPLE PAIRS OF GEARS

[75] Inventors: Donald L. Guile, Horseheads, N.Y.; Lucretia R. Quatrini, Sayre, Pa.

[73] Assignee: Corning Incorporated, Corning, N.Y.

[21] Appl. No.: 801,661

[22] Filed: Dec. 2, 1991

[51] Int. Cl.[5] ..... F04B 23/08

[52] U.S. Cl. ..... 417/205; 417/244; 418/9

[58] Field of Search ..... 417/205, 199.1, 244, 417/320; 418/9, 10

[56] References Cited

U.S. PATENT DOCUMENTS 1,214,300 1/1917 Grouvelle et al. ..... 418/9
4,679,710 7/1987 Jameson et al. ..... 418/9

FOREIGN PATENT DOCUMENTS 0026585 8/1920 Denmark ..... 418/9
0037294 10/1981 European Pat. Off. ..... 417/205

*Primary Examiner*—John J. Vrablik
*Assistant Examiner*—Charles Freay
*Attorney, Agent, or Firm*—L. Rita Quatrini

[57] ABSTRACT

An improvement is provided in a gear pump comprising a pair of intermeshing gears enclosed in a housing, the improvement comprising having at least one additional pair of intermeshing gears, wherein the gear pairs are non-meshing with one another.

3 Claims, 4 Drawing Sheets

GEAR PUMP HAVING MULTIPLE PAIRS OF GEARS

CROSS REFERENCE TO RELATED APPLICATION

This application is related to application Ser. No. 07/801,361, entitled "Improved Extrusion Method For Producing A Body From Powder Material", which is being filed concurrently herewith.

BACKGROUND OF THE INVENTION

This invention relates to an improvement in a gear pump, the improvement being having more than one pair of gears in the gear pump housing. Advantages of having more than one pair of gears over one pair is that higher pressures can be generated in material passing through the gear pump, and the pressure differential is distributed over the multiple gear pairs. Furthermore, because the speed of each gear pair can be controlled separately, there is greater flexibility in choosing operating parameters. One of the preferred contemplated uses of the improved gear pump of the present invention is in extrusion processing of powder material in which the material is passed through an extruder, through the gear pump, and then through a die to form an article.

In the extrusion of filled systems of powder material, such as those used for catalyst supports, for example, ceramic honeycombs, considerable pressure is required in order to force the material through the extrusion die. At present, this is achieved with a hydraulic ram extrusion press, or a two stage de-airing single auger extruder, or in a twin screw mixer with a die assembly attached to the discharge end. In the latter, the proper screw elements are chosen according to material and other process conditions in order to build up sufficient pressure to force the batch material through the die.

There are disadvantages associated with these pressure creating devices especially in extrusion of ceramic materials. For example, in the case of the ram extruder, the process is an intermittant one and there is no means to remove any inhomogeneities in the materials. Also upon reloading the extruder with a new charge of material, an interface is formed between the remaining materials and the new charge. This can and does create defects in the material. In the case of a single screw extruder, the material moves in plug flow, and where it is in contact with the screw and walls of the extruder, the material sees considerable shear. If a die is attached directly to the single screw, the material due to rheology differences, will extrude differently across the face of the die. In a twin screw mixer used as an extruder, this effect will be decreased. However, in both types of extruder there will be a pulsation in pressure due to the batch coming off the screws. This pulsation affects the quality of the extruded piece. In the case of a single screw extruder, it is difficult to generate high pressure needed to extrude thin walled cellular structures. The twin screw mixer can generate the required pressures but the high pressure results in considerable wear of the screw elements and barrel walls. Also the work input required to generate the pressure in the twin screw mixer increases the batch temperature which changes the extrusion characteristics of the batch. In an effort to overcome screw memory and pulsation, an orifice is often used between the extruder and die. While this can be effective, it requires an increase in pressure from the extruder and does not remove the pulsation from the screw tips.

It would be advantageous therefore, to have an apparatus capable of generating high pressures that can be used in an extrusion process for powder material, so that the above described disadvantages are eliminated and extrusion conditions would be stabilized and controlled to consistently produce high quality products.

SUMMARY OF THE INVENTION

In accordance with one aspect of the invention, there is provided an improvement in a gear pump comprising a pair of intermeshing gears enclosed in a housing, the improvement comprising having at least one additional pair of intermeshing gears, wherein the gear pairs are non-meshing with one another.

DETAILED DESCRIPTION OF THE INVENTION

The present invention provides an improvement in a gear pump, the improvement being having more than one pair of intermeshing gears in the gear pump housing. One of the advantages of having more than one pair of gears over one pair is that higher pressures can be generated in a material as it passes through the gear pump. The pressures are distributed over the multiple gear pairs. The speed of each gear pair can be varied somewhat, to balance the pressure differentials and optimize the process.

The gear pump itself can take the form of any conventional gear pump available today, except that the housing is enlarged to accommodate the additional pair or pairs of intermeshing gears. The additional pair or pairs of gears can be affixed in the housing in any conventional manner, the same as the first pair. There can be a pressure monitoring device such as a transducer between the gear pairs to monitor the pressure at that point. It is to be understood that any additional modifications can be made to the gear pump, e.g. entrance or exit ports, etc. to accommodate any type or direction of material flow, without departing from the scope of the invention.

In accordance with one embodiment, the gear pairs can be arranged co-planar with respect to one another.

In accordance with another embodiment, the gear pairs can be arranged at angles with respect to one another, for example at right angles.

Figure 3:
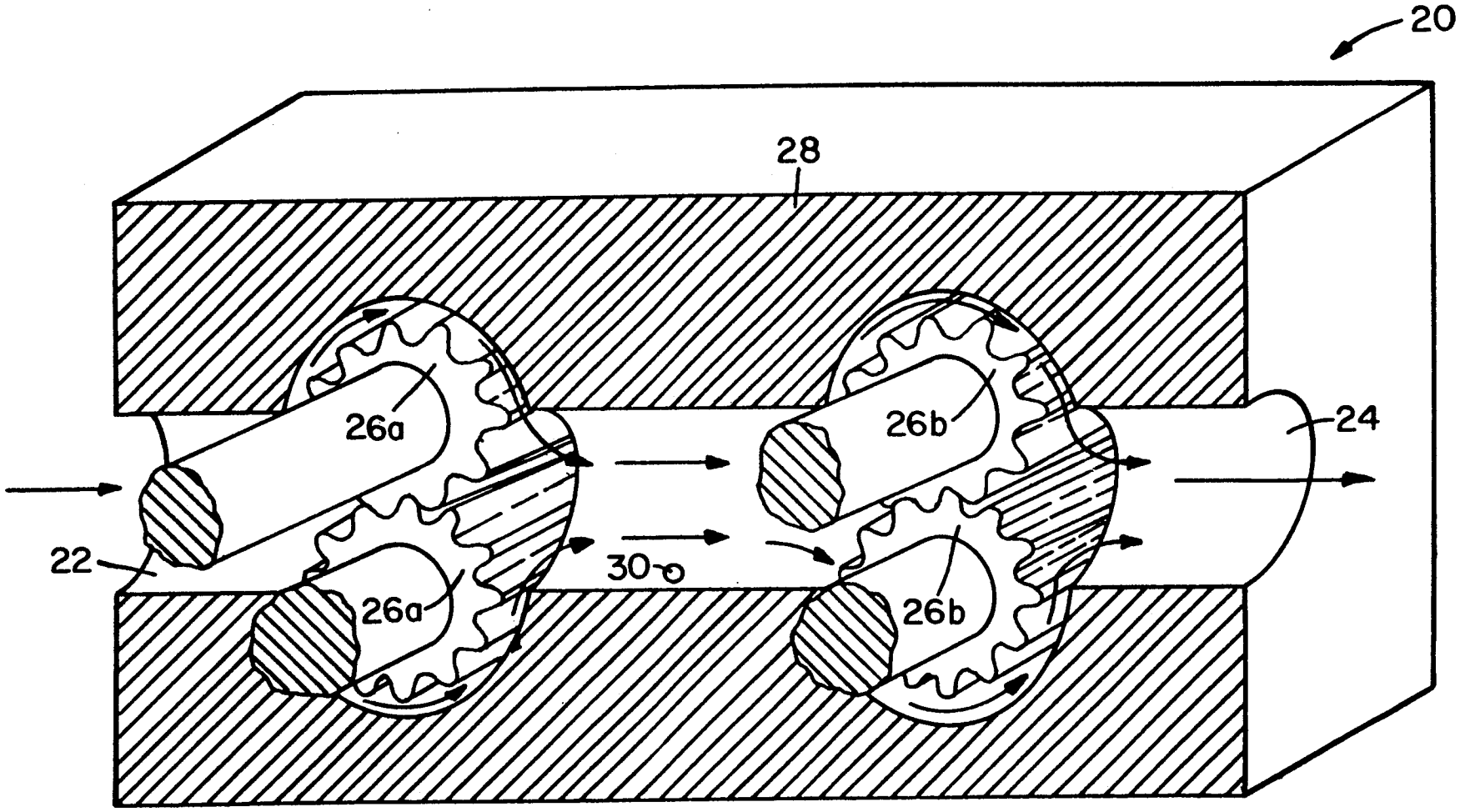
FIG. 3 is a cross sectional view showing the gear pump of the present invention with two pair of gears arranged co-planar with respect to one another and showing the flow of material through the gear pairs.
Figure 4:
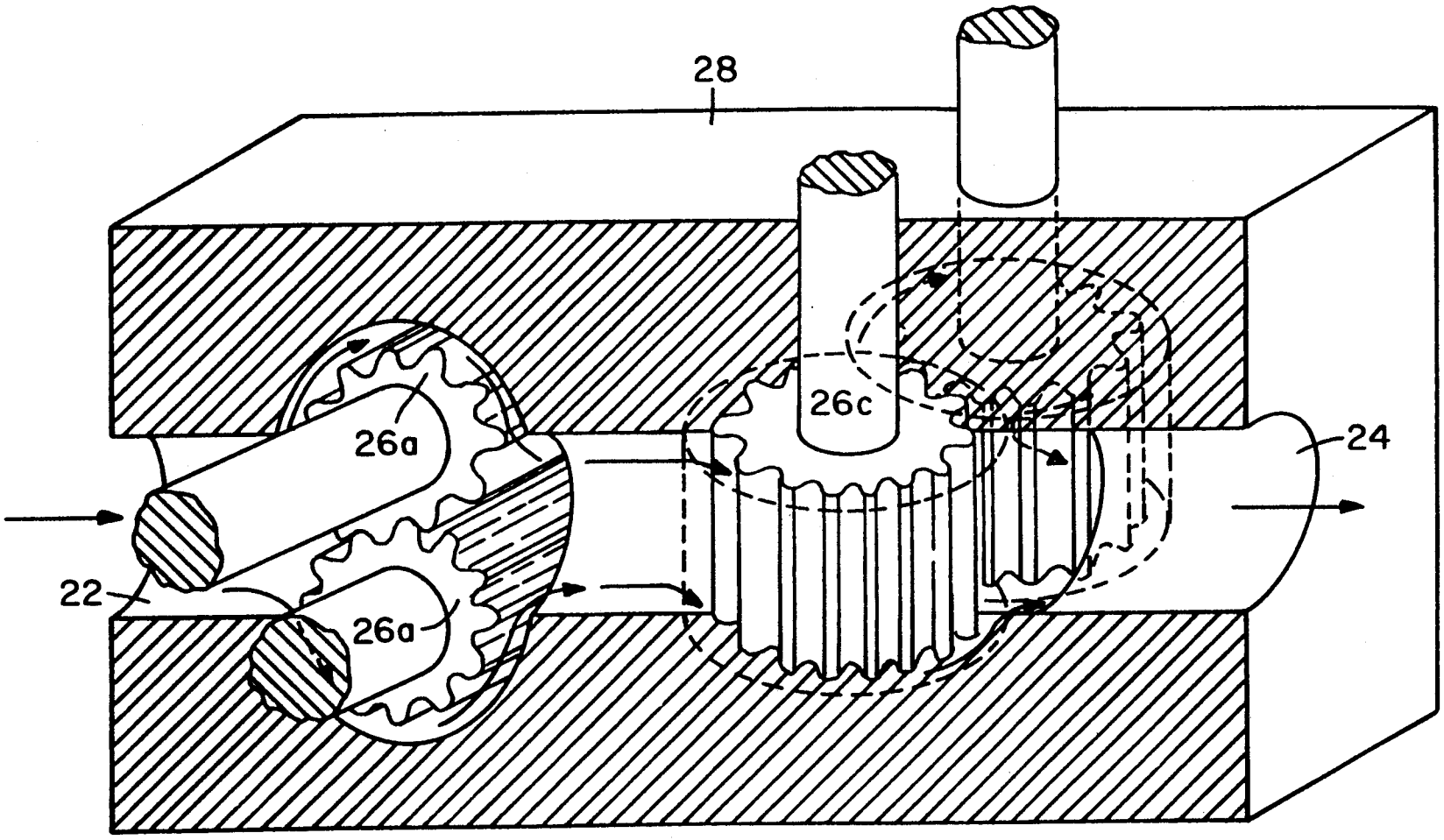
FIG. 4 is a cross sectional view showing the gear pump of the present invention with two pair of gears arranged at right angles to one another and showing the flow of material through the gear pairs.

These arrangements are shown in FIGS. 3 and 4 respectively and will be described later in connection with a preferred application in an extrusion process.

One of the preferred contemplated uses of the improved gear pump of the present invention is in extrusion processing of powder material in which the material, provided in the form of a mixture which includes a vehicle, is passed through an extruder and then through a die to form an article. The improved gear pump of the present invention is placed after the extruder and before the die so that a powder material passes through the extruder, and then through the gear pump and thereafter through the die. In accordance with one embodiment of the present invention, there can be more than one gear pump(s) positioned in series so that the mixture can pass through the inlet and outlet ends of each one in succession and finally to the extrusion die. One or more of the gear pumps can have multiple pairs of gears depending on the particular process parameters. The improved gear pump is used preferably in extrusion of highly filled powder mixtures. When a material passes through the gear pump, it passes successively from one gear pair to the next, through the gear teeth of the respective gears from the inlet end to the outlet end of the gear pump.

Use of a gear pump offers the advantages of a stabilized and controlled process for continuously extruding powder material. The gear pump allows high pressures to be built up in the material so that the extrusion is carried out smoothly without pulsations. Products of uniform size and shape, can be produced as evidenced by continuous or uniform cross sections within the body. These improvements are evident even in complex shapes such as honeycombs. Moreover, the improvement of using a gear pump in the extrusion is especially suited for highly filled powder mixtures. Extrusions can be carried out at lower temperatures and reduced thermal gradients within the batch as it approaches the die, than in processes without the gear pump. The temperature of the material throughout the extrusion operation is below the gel point of the vehicle/binder system in the powder mixture.

In the powder/vehicle mixture, the powder materials must be relatively insoluble in the vehicle. The typical powder materials are ceramic material, glass, glass ceramic material, metal, metal-alloy, cermet, elemental carbon, organic material, and combinations of these. One example of a metal or metal/alloy type of mixture, although it is to be understood that the invention is not limited to such, is a mixture of Fe, Cr, and Al metal and/or metal alloy powders with various additions such as other metals, alloys, or oxides, etc. Honeycombs are a typical shape extruded from this type of mixture. Ceramic materials are especially suited to the practice of the present invention. Ceramic material according to the present invention includes, in addition to ceramics, the raw materials which form ceramics on firing.

The vehicle can be any material that will form a wet mixture, such as water, or suitable organics. A plasticizer can be chosen from a number of organic materials depending on the application.

For example, with ceramic powders, a suitable plasticizer is methylcellulose or polyvinylalcohol. Other extrusion aids such as deflocculants, lubricants, wetting agents, etc. can be present if necessary depending on the mixture composition. Some typical mixture compositions are combinations of clays, talcs, aluminas, mullite, such that when reacted form cordierite. These mixtures are highly filled.

By highly filled is meant the solid to liquid content of the mixture is high. For example, the powder material content in the mixture is typically at least about 45% by volume, and most typically about 50% by volume.

Some typical highly filled mixtures having the composition for a cordierite forming batch are about 100 weight parts of powder to about 30 weight parts of water or about 77% by weight powder, and about 23% by weight water. The powder specific gravity for this composition is about 2.5 on the average. In terms of volume, the typical composition is about 30 parts by volume powder and about 23 parts by volume water or about 57% by volume powder and about 43% by volume water.

In accordance with a preferred embodiment, one composition which ultimately forms cordierite upon firing is as follows in percent by weight, although it is to be understood that the invention is not limited to such: about 33 to about 41, and most preferably about 34 to about 40 of aluminum oxide, about 46 to about 53 and most preferably about 48 to about 52 of silica, and about 11 to about 17 and most preferably about 12 to about 16 magnesium oxide. The components are supplied typically, but not exclusively, as clay and talc and alumina, such as Georgia Kaolin Hydrite MP raw clay, Georgia Kaolin Glomax LL calcined clay, Pfizer talc, and Alcan C-701 alumina. This composition is dry-blended with a methylcellulose such as Dow A4M Methocel® and a surfactant (wetting agent) such as sodium stearate. It is preferred that the powder material be fine powder (in contrast to coarse grained materials) which either impart plasticity, such as clays, when mixed with a vehicle such as water, or combined with organic materials such as methylcellulose or polyvinylalcohol which can contribute to plasticity. Typically with this type of composition, the bulk of the cordierite-forming powder components falls in the range of about 1 micrometer to about 15 micrometers in diameter, with the clays containing a fraction less than about 1 micrometer in diameter, and the alumina and talc having some particles greater than about 15 micrometers in diameter. The powders can be synthetically produced materials such as oxides, hydroxides, etc, or they can be naturally occurring minerals such as clays, talcs, or any combination of these. Of particular interest for the present invention are materials which can be extruded in the form of cellular structures or honeycombs, and which produce a cordierite body upon firing.

If metal or metal alloy mixtures are used as described above, it is advantageous to include a binder such as methylcellulose or polyvinylalcohol. It is especially advantageous to include an aid to prevent oxidation, such as organic acids, for example oleic acid. Water is typically used as the vehicle.

The improvement afforded by the present invention results in improved dimensional control in a body having a constant cross section when cut perpendicular to the extrusion direction. The bodies according to the present invention can have any convenient size and shape. However, the process is especially suited to production of cellular bodies such as honeycombs, especially cordierite honeycombs. Cellular ceramics find use in a number of applications such as catalyst carriers, filters such as diesel particulate filters, molten metal filters, regenerator cores, etc. Some examples of honeycombs which can be produced using the improvement of the present invention, although it is to be understood that the invention is not limited to these, are those having about 94 cells/cm$^2$ (about 600 cells/in$^2$), about 62 cells/cm$^2$ (about 400 cells/in$^2$), or about 47 cells/cm$^2$ (about 300 cells/in$^2$), those having about 31 cells/cm$^2$ (about 200 cells/in$^2$), or those having about 15 cells/cm$^2$ (about 100 cells/in$^2$). These bodies are made preferably of, but not limited, to materials which when fired form cordierite. Typical wall thicknesses in catalytic converter applications, for example, are about 6 mils (about 0.15 mm) for 400 cells/in$^2$ (62 cells/cm$^2$) honeycombs. Web thicknesses range typically from about 4 to about 25 mils (about 0.1 to about 0.6 mm). The external size and shape of the body is controlled by the application, e.g. engine size and space available for mounting, etc.

Once the desired mixture composition is made up, it is subjected to a series of operations to plasticize and pressurize it to a first pressure. The first pressure is sufficient to fill the gear teeth on the inlet end of the gear pump (or inlet end of the first gear pump if more than one are used). The first pressure can vary depending on the type of material and the type of product that is to be extruded. For example, for extrusion of ceramic materials to form honeycombs, the typical first pressures are about 300 to about 1000 psi.

The plasticizing and first pressurizing can be done in several ways. In general, any type of device which can de-air the mixture and provide typically up to about 500 psi is suitable. Some suitable ways of first pressurizing will now be described, although the invention is not limited to these.

Figure 1:
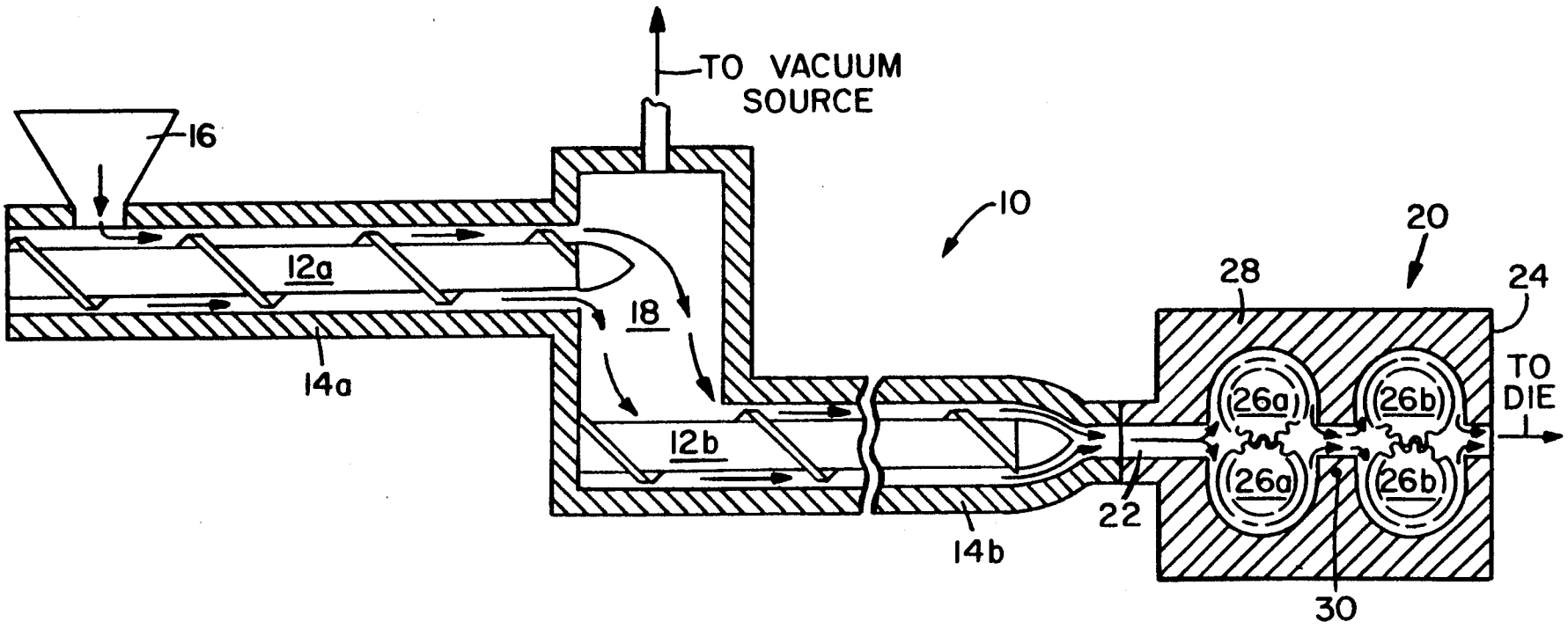
FIG. 1 is a diagram showing the gear pump of the present invention as used in an extrusion process with a two stage single screw extruder.

In accordance with one embodiment, the mixture is homogenized and plasticized in a muller type of mixer or a double arm mixer. The plasticized material is then fed through a two stage single screw de-airing extruder which is commonly called a "single screw extruder". FIG. 1 shows the arrangement of a typical two stage single screw extruder with respect to a gear pump in the practice of the present invention. Each stage of the single screw extruder (10) is comprised of an auger screw (12*a*) and (12*b*) in a barrel (14*a*) and (14*b*). The plasticized mixture is introduced into the extruder through a device such as a hopper (16). In the first stage of the extruder, the mixture is picked up by auger screw (12*a*) and compacted in barrel (14*a*) as it moves toward the discharge end of the barrel, thus forming a vacuum seal. The direction of the material from introduction to the extruder to entrance to the die is shown by the arrows. The mixture is then shredded or noodled in a shredder (not shown) as it enters a vacuum de-airing chamber (18) to remove any trapped air within the mixture. The de-aired mixture drops to the bottom of the de-airing chamber where it is picked up by the second stage screw (12*b*). This compacts the material in barrel (14*b*) and builds up necessary pressure for the input to the gear pump (20). As a result of passage through the two stage single screw extruder, the mixture is compacted, shredded, de-aired, compacted, and then pressurized to a first pressure.

Figure 2:
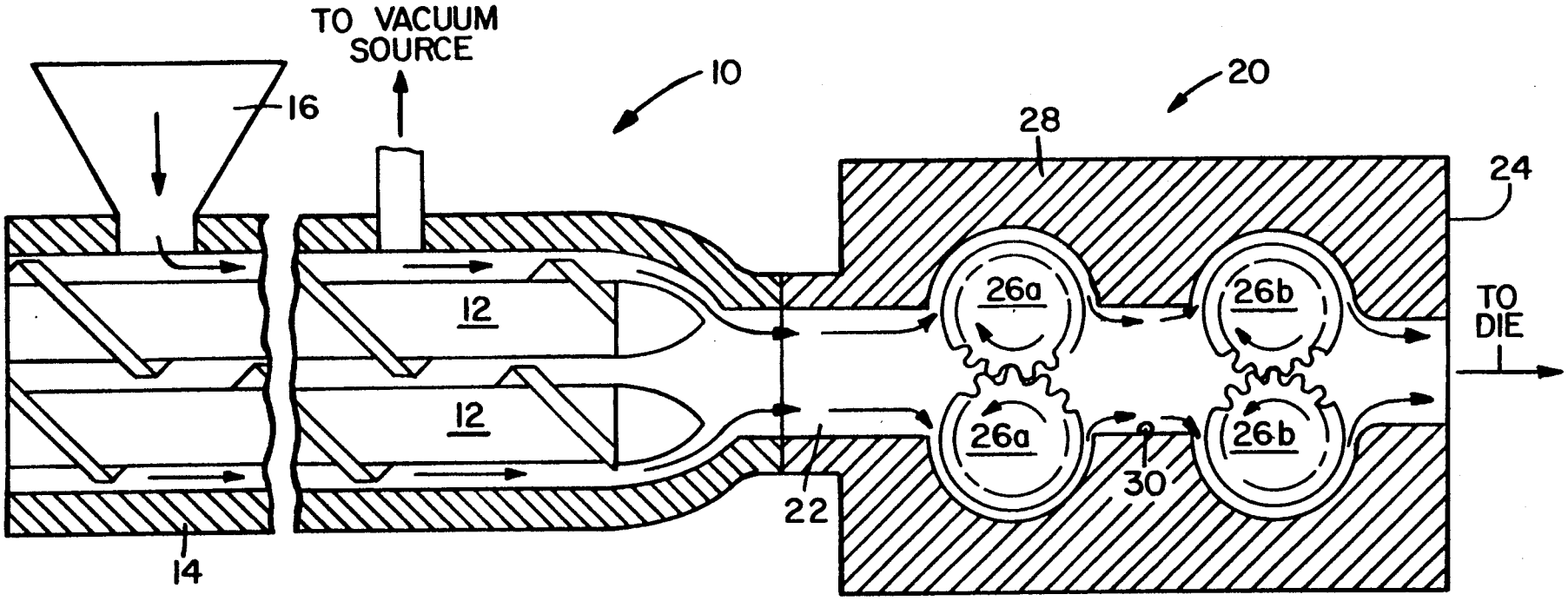
FIG. 2 is a diagram showing the gear pump of the present invention as used in an extrusion process with a twin screw extruder.

In accordance with another embodiment, the mixture is homogenized, plasticized, de-aired, and first pressurized in a twin screw mixer which in this embodiment, functions as the extruder. FIG. 2 shows the arrangement of a typical twin screw extruder with respect to a gear pump in the practice of the present invention. The twin screw mixer (10) comprises two parallel screws (12) in a barrel (14). The screws can be co-rotating or counter-rotating, intermeshing or non-meshing, although it is the usual practice to have co-rotating intermeshing screws. The mixture enters the twin screw mixer through a device such as a hopper (16) and is picked up by the screws. The direction of the material flow is shown by the arrows. The twin screw mixer provides the first pressure to the input side of the gear pump (20) if one gear pump is used as shown in FIG. 2, or the input side of the first gear pump if more than one are used.

In accordance with another embodiment, the mixture is homogenized, plasticized, de-aired, and first pressurized by being passed first through a twin screw mixer and thereafter through a single stage single screw extruder to achieve the first pressure. The single screw extruder is placed at right angles to the exit end of the twin screw mixer. On the input end of the single screw extruder, a vacuum is drawn so that the material is transferred along the barrel of the single screw extruder where it is compacted and pressurized and fed to the gear pump. For the purposes of the present invention, this arrangement of single screw and twin screw mixers and chambers is considered the extruder.

The first pressurized mixture is then passed through the gear pump for the purpose of insuring homogeneity and uniform viscosity in the mixture while it is being transported to the extrusion die. The typical arrangement of a gear pump of the present invention is shown in FIGS. 1 and 2. Cross sectional views showing some arrangements of the gear pairs and the flow of material through the respective pairs are shown in FIGS. 3 and 4. The operation of the gear pump of the present invention in an extrusion process will be described with the aid of these figures. The gear pump has an inlet end (22) and an outlet end (24), and comprises two pair of intermeshing gears shown in FIG. 3 as (26*a*) and (26*b*), and in FIG. 4 as (26*a*) and (26*c*). The gears in a pair are counter-rotating with respect to one another. The gears are enclosed in a housing (28). The inside of the housing defines the path of material flow through the gear pump. It is preferred that part of the inside of the housing be configured in the shape of at least part of the non-meshing portion of the gears. It is preferred that there be a very close tolerance between this part of the inner surface and the non-meshing part of the gears to prevent back-flow of the material. The gear pairs are mounted separately so that the speed of each pair can be controlled separately to balance the pressure differentials.

The first pressurized mixture enters the gear pump through the inlet end and is fed into the spaces between the gear teeth of the first gear pair (26*a*). The material is picked up in the spaces between the gear teeth of the first gear pair (26*a*), and is carried by the counter-rotating motion of the gears (26*a*), to the space between the two gear pairs where it is forced out as the teeth of the first gear pair (26*a*) mesh together. The speed of gear pair (26*a*) can be adjusted so that the material achieves a pressure that is intermediate between the first pressure and the second pressure that will be required to force the material through the extrusion die. A pressure monitoring device (30) such as a transducer monitors the pressure so that gear speeds can be adjusted if necessary. At this point, the material is then picked up in the spaces between the gear teeth of the second gear pair (26*b*) or (26*c*), and is carried by the counter-rotating motion of the gears (26*b*) or (26*c*), to the outlet end of the gear pump where it is forced out as the teeth of the second gear pair mesh together. The speed of the second gear pair can be adjusted so that the material achieves the second pressure that is required to force the material through the extrusion die. Passage of the material through the gear pump as described above, results in generation of the second pressure (the extrusion pressure) which is the pressure required to push the material through the extrusion die.

As the material is picked up in the spaces between the gear teeth of each gear pair, it separates. As the material is forced out of each gear pair, it is recombined, thus helping to homogenize the material and to remove any memory due to the screws of the feeding devices, and to remove pressure pulsations from the screws while increasing the material pressure to the extrusion pressure. As with the first pressure, the extrusion pressure depends on factors such as the type of material and the type of product that is to be extruded, and also on the type of extrusion die that is used. For example, for simple shapes with thick sections, it may be about a few hundred psi. For extrusion of ceramic materials to form honeycombs, the typical second pressures can be about 750 to about 2500 psi or more depending mainly on web thickness.

One advantage of having more than one pair of gears is that when two or more pairs of gears are placed in series, the differential pressure between the initial input to the output which provides the extrusion pressure is divided between the gear pairs. As an illustration, if, for example, the input pressure to the gear pump (first pressure) is about 500 psi and the extrusion pressure (second pressure) is about 2500 psi, the pressure differential is about 2000 psi. With two gear pairs in series, the pressure differential is the sum of the pressure differental across each gear pair. Therefore, higher pressures can be attained with multiple gear pairs. This results in more overall flexibility in operating the extrusion process. One additional advantage of having the gear pairs rotated, for example at about 90° angles with respect to one another as shown in FIG. 4, is to further enhance homogenization and reduction in batch memory due to the feeding screws of the extruder.

Gear pumps having one pair of gears are commerically available. One typical gear pump is Model No. 110x manufactured by Normag corporation. The intermeshing gears and their housing form what is called a positive displacement gear pump which is capable of generating the required pressure for extrusion. As the material passes from one gear pair to another from the inlet end to the outlet end of the gear pump, it is displaced as the gear teeth mesh back together. The pressure is created by the fact that where the gear teeth come together, the material is being squeezed out. As the gear teeth open, a void or vacuum is created causing material to be sucked into the spaces between the gear teeth. Pressure on this side helps fill the spaces between the gear teeth. The material is then carried through the gear pump and constrained by the close tolerance between the inner surface of the housing and the non-meshing gear portion to prevent back flow. The gears are driven by a variable speed drive motor. This gives a pumping capacity range for any gear pump. The volume which can be pumped depends on the gear speeds of the respective gear pairs. The output pressure is more a result of the type of die used or anything which constricts flow. Therefore, for any gear speed, the pressure can vary for different types of dies. Also if the gear pump is run at different speeds for a given die, the pressure varies since it takes more pressure to push material through a given die at a faster rate. The amount of material pumped for a given gear speed remains relatively constant regardless of the first pressure on the input side of the gear pump. This is why it is called a positive displacement pump. When a twin screw extruder is used, the profile of the twin screws can be altered to improve mixing, rather than to create pressure, since the twin screw is not required to generate the second pressure (extrusion pressure) as it is when a gear pump is not used. This then requires less energy input to the twin screw extruder, and thus into the material, resulting in lower material temperature.

The invention is not limited to the number of gear pairs or to their orientation. Any number of gears pairs can be included in a gear pump, in any combination of spacial orientations that is expedient for the particular application.

The invention is not limited to the types of gear teeth configurations. Most typically, however, the gear teeth are helical, spur, or herringbone. While any type of gear teeth design will work in the practice of the present invention, helical gear teeth discharge the mixture continuously since as the gear teeth come together, material is forced out of each segment starting at one end where each tooth first meshes with teeth on the other gear and progressing across the gear to the other end as the gears rotate. When one segment is nearly closed, (done providing material) the next segment is starting to close. This results in a smooth continuous flow of material.

With a given pair of gears, the type of gear teeth must be the same to insure that they intermesh. However, gear pairs can differ from one to the other as far as the type of gear teeth. From a practical standpoint however, it is normal practice that all the gears have the same type of teeth.

The second pressurized mixture is then extruded through a die to form a green body. The die can have any configuration depending on the desired shape of the body. For example, one desired shape is that of a honeycomb, and any die used for extrusion of honeycombs can be used.

The green body can then be dried and sintered by known processes to densify it and to react the mixture components to form the desired product.

To more fully illustrate the invention, the following non-limiting examples are presented. All parts, portions, and percentages are by weight unless otherwise stated.

EXAMPLE 1

The following is an example of use of the improved gear pump of the present invention in an extrusion process in conjunction with a twin screw mixer as the extruder, and a die, to produce a ceramic honeycomb structure as the article. The structure is used typically as a substrate for catalysts.

A mixture is made up of raw materials of alumina, silica and magnesium oxide in proportions which when fired will form cordierite. Methylcellulose as binder, sodium stearate as wetting agent, and water are added in amounts needed to form a plasticizable mixture. The components are dry blended followed by addition of water to form a damp powder. The mixture is then fed at a constant rate into a twin screw mixer, in this case, the screws are co-rotating and intermeshing. The twin screw mixer receives the mixture, mixes it and plasticizes it as the mixture is moved by the screws. The mixture then exits to a gear pump having two pairs of helical counter-rotating intermeshing gears. The output pressure from the twin screw mixer is sufficient to fill the spaces between the gear teeth of the first gear pair on the input side of the gear pump. The pressure of the material is increased to a pressure intermediate between the initial pressure and the required extrusion pressure.

The material at the intermediate pressure exits the first gear pair and is picked up in the spaces between the teeth of the second gear pair. The output from the second gear pair which is now at the extrusion pressure, is then passed through a transition zone to a die which forms the desired cellular structure as the material passes through it. The improved gear pump develops the necessary pressure required to extrude the mixture through the die but with less pressure on each gear pair than if one pair were used.

It should be understood that while the present invention has been described in detail with respect to certain illustrative and specific embodiments thereof, it should not be considered limited to such but may be used in other ways without departing from the spirit of the invention and the scope of the appended claims.

What is claimed is:

1. In a gear pump comprising a pair of intermeshing gears enclosed in a housing, the improvement comprising having at least one additional pair of intermeshing gears, wherein said pairs are non-meshing with one another and wherein said pairs are rotated with respect to one another.

2. The improvement of claim 1 wherein said gear pump has one additional pair of gears.

3. The improvement of claim 1 wherein said gear pairs are rotated at about 90° angles with respect to one another.

* * * * *